US011203987B2

(12) United States Patent
Ono et al.

(10) Patent No.: US 11,203,987 B2
(45) Date of Patent: Dec. 21, 2021

(54) AIR SUPPLY DEVICE OF STRATIFIED SCAVENGING TWO-CYCLE ENGINE

(75) Inventors: Ryou Ono, Saitama (JP); Takashi Ohniwa, Tokyo (JP)

(73) Assignee: Husqvarna Zenoah Co., Ltd., Saitama (JP)

( * ) Notice: Subject to any disclaimer, the term of this patent is extended or adjusted under 35 U.S.C. 154(b) by 479 days.

(21) Appl. No.: 13/884,019

(22) PCT Filed: Nov. 8, 2010

(86) PCT No.: PCT/JP2010/006542
§ 371 (c)(1),
(2), (4) Date: May 8, 2013

(87) PCT Pub. No.: WO2012/063276
PCT Pub. Date: May 18, 2012

(65) Prior Publication Data
US 2013/0228152 A1 Sep. 5, 2013

(51) Int. Cl.
*F02D 9/02* (2006.01)
*F02M 17/04* (2006.01)
*F02M 9/08* (2006.01)

(52) U.S. Cl.
CPC ..... *F02D 9/02* (2013.01); *F02M 9/08* (2013.01); *F02M 17/04* (2013.01)

(58) Field of Classification Search
USPC ..... 123/65 R, 319
See application file for complete search history.

(56) References Cited

U.S. PATENT DOCUMENTS 4,716,878 A * 1/1988 Shimada ..... F02M 15/06 123/184.21
4,835,866 A 6/1989 Nagashima
(Continued)

FOREIGN PATENT DOCUMENTS

DE 10326488 A1 4/2004
DE 102006032475 A1 1/2008
(Continued)

OTHER PUBLICATIONS

Machine Translation of JP 2001295652 A PDF File Name: "JP2001295652A_Machine_Translation.pdf".*
(Continued)

*Primary Examiner* — David Hamaoui
*Assistant Examiner* — Ruben Picon-Feliciano
(74) *Attorney, Agent, or Firm* — Burr & Forman, LLP

(57) ABSTRACT

An air supply device (1) of a stratified scavenging two-cycle engine includes: a mixture passage (40) that penetrates a carburetor (2) and an insulator (3), the mixture passage being provided by a carburetor-side mixture passage (8) and an insulator-side mixture passage (21); a air passage (41) that is provided by a carburetor-side air passage (9) and an insulator-side air passage (22); a throttle valve (13) provided in a single bore (4) of the carburetor (2), the throttle valve(13) being provided by a butterfly valve that rotates in conjunction with a throttle operation; and a flow rate regulator (28) provided inside the air passage (41), the flow-rate regulator (28) bulging inward in the air passage (41). At least a part of a periphery of a valve body (17) of the throttle valve is close to the flow-rate regulator (28) until the valve body (17) is rotated from an initial position corresponding to an idling speed at a predetermined rotation angle.

14 Claims, 9 Drawing Sheets

(56) References Cited

U.S. PATENT DOCUMENTS

| | | | | |
|---|---|---|---|---|
| 2003/0222357 | A1* | 12/2003 | Braun | F02D 9/106 261/35 |
| 2004/0051186 | A1 | 3/2004 | Gerhardy | |
| 2006/0219217 | A1 | 10/2006 | Dow et al. | |
| 2009/0007894 | A1* | 1/2009 | Wada et al. | 123/73 V |
| 2009/0013963 | A1* | 1/2009 | Eberhardt et al. | 123/337 |
| 2009/0212448 | A1 | 8/2009 | Magnus | |
| 2009/0314243 | A1 | 12/2009 | Schmidt et al. | |

FOREIGN PATENT DOCUMENTS

| | | | | |
|---|---|---|---|---|
| JP | 2001295652 | A | * | 10/2001 |
| JP | 2003193911 | A | | 7/2003 |
| JP | 2004316559 | A | | 11/2004 |
| JP | 20060266266 | A | | 4/2008 |
| JP | 4909574 | B2 | | 4/2012 |
| WO | 2008033062 | A1 | | 3/2008 |

OTHER PUBLICATIONS

International Search Report and Written Opinion of PCT/JP2010/006542 dated Jun. 16, 2011.

Chapter I International Preliminary Report on Patentability of PCT/JP2010/006542 dated May 14, 2013.

* cited by examiner

[Fig. 1]
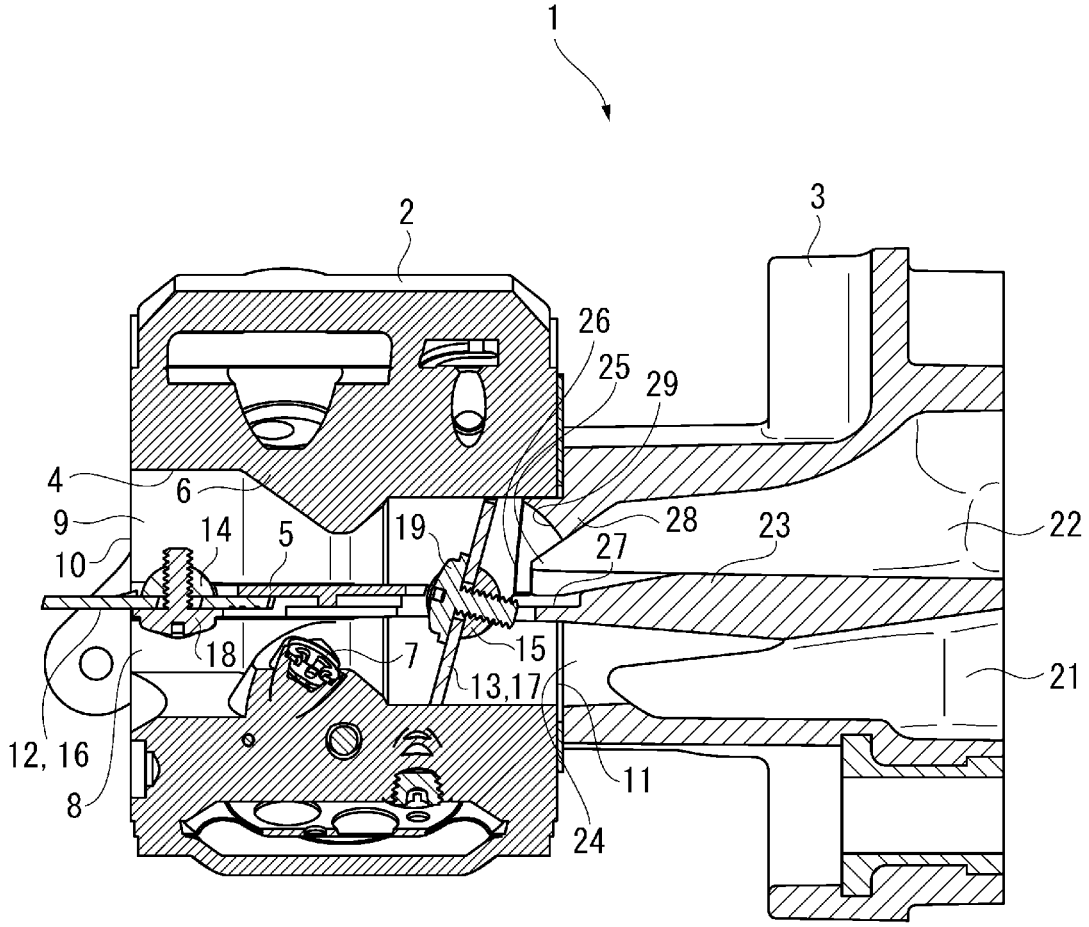

[Fig. 2]
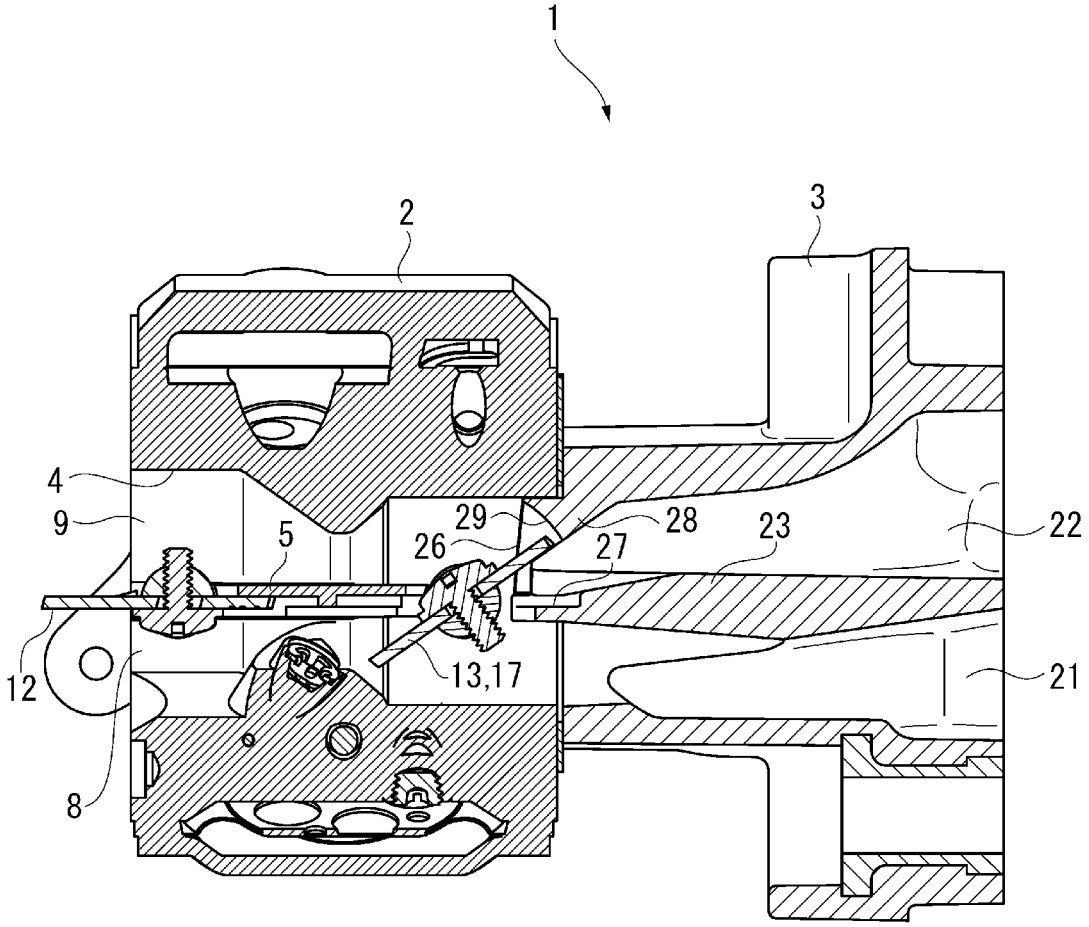

[Fig. 3]
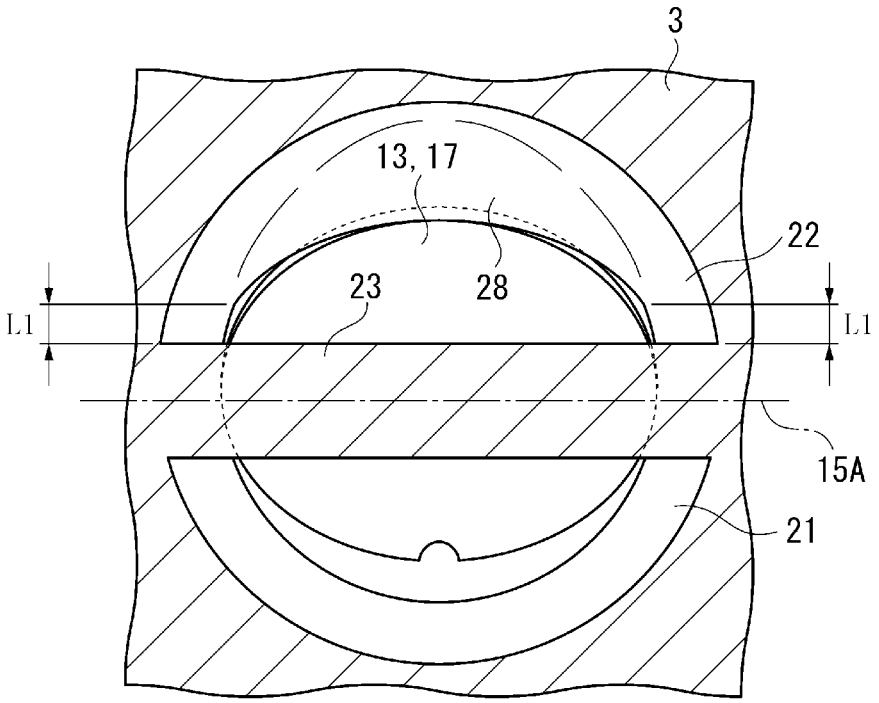

[Fig. 4]
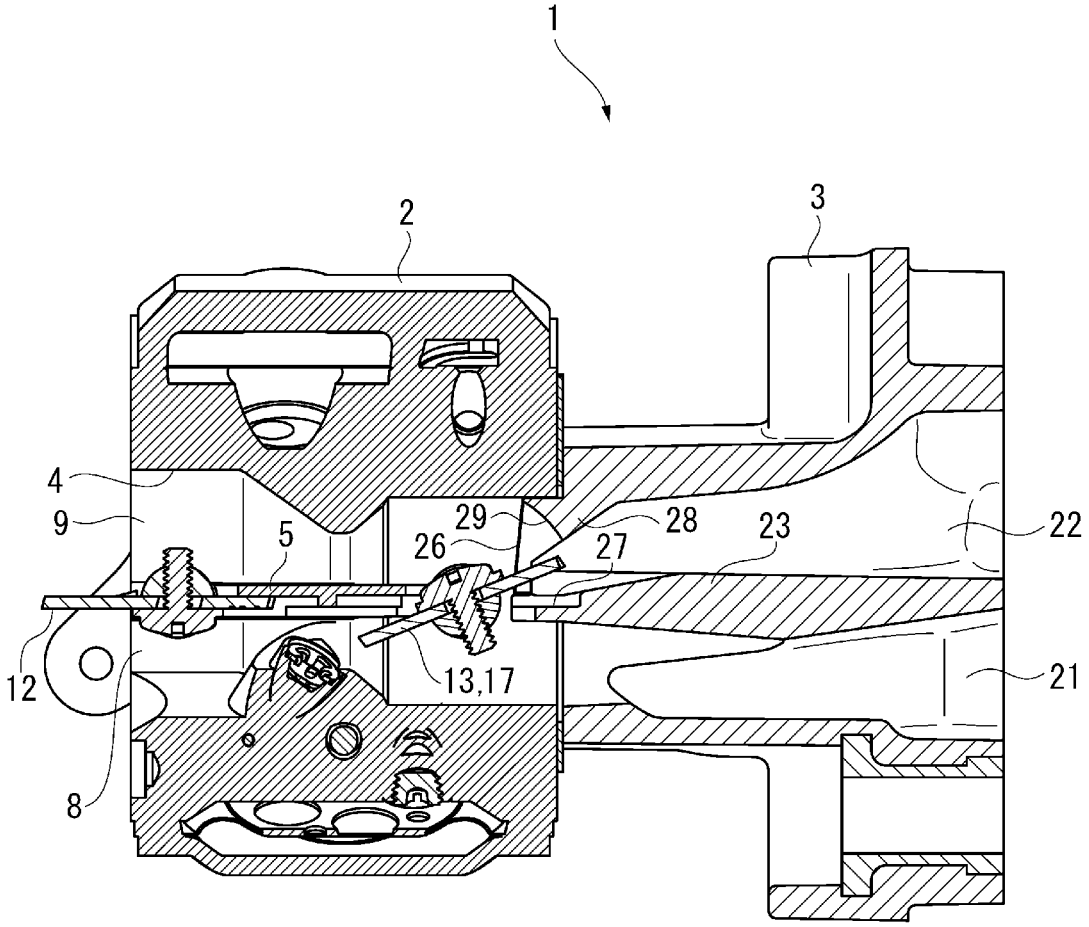

[Fig. 5]
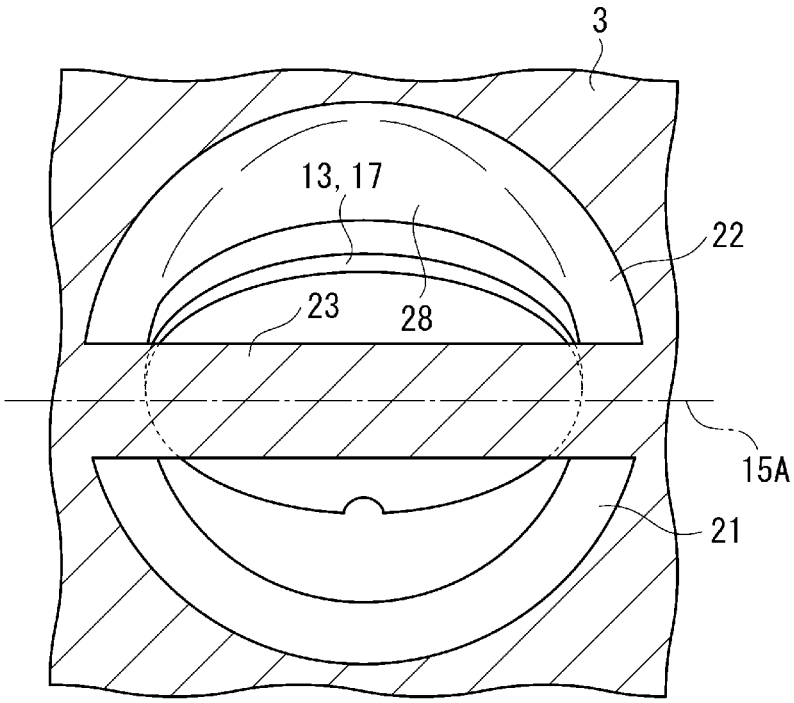

[Fig. 6]
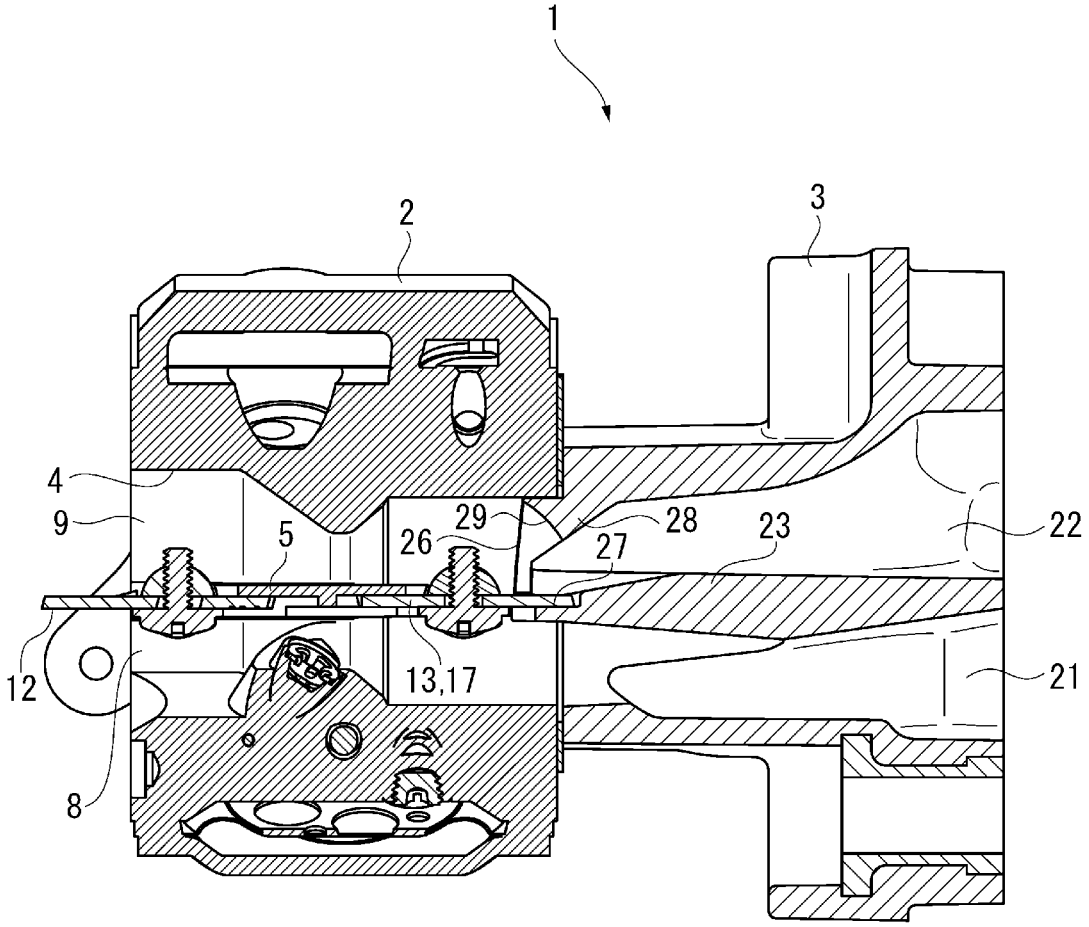

[Fig. 7]
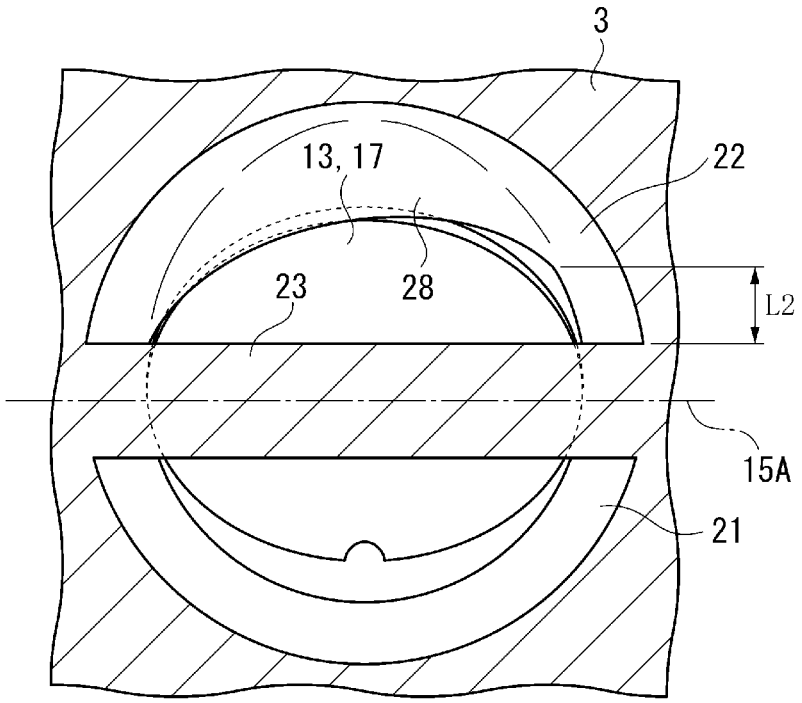

[Fig. 8]
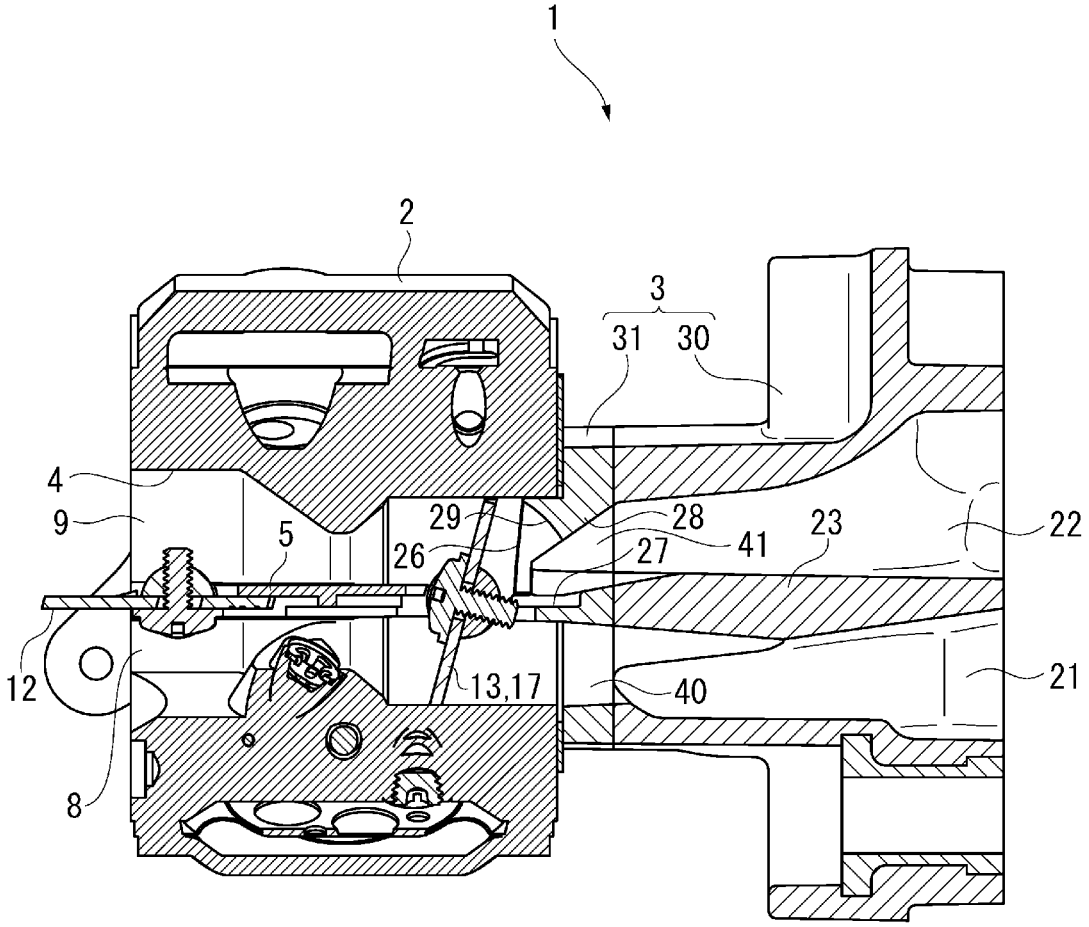

[Fig. 9]
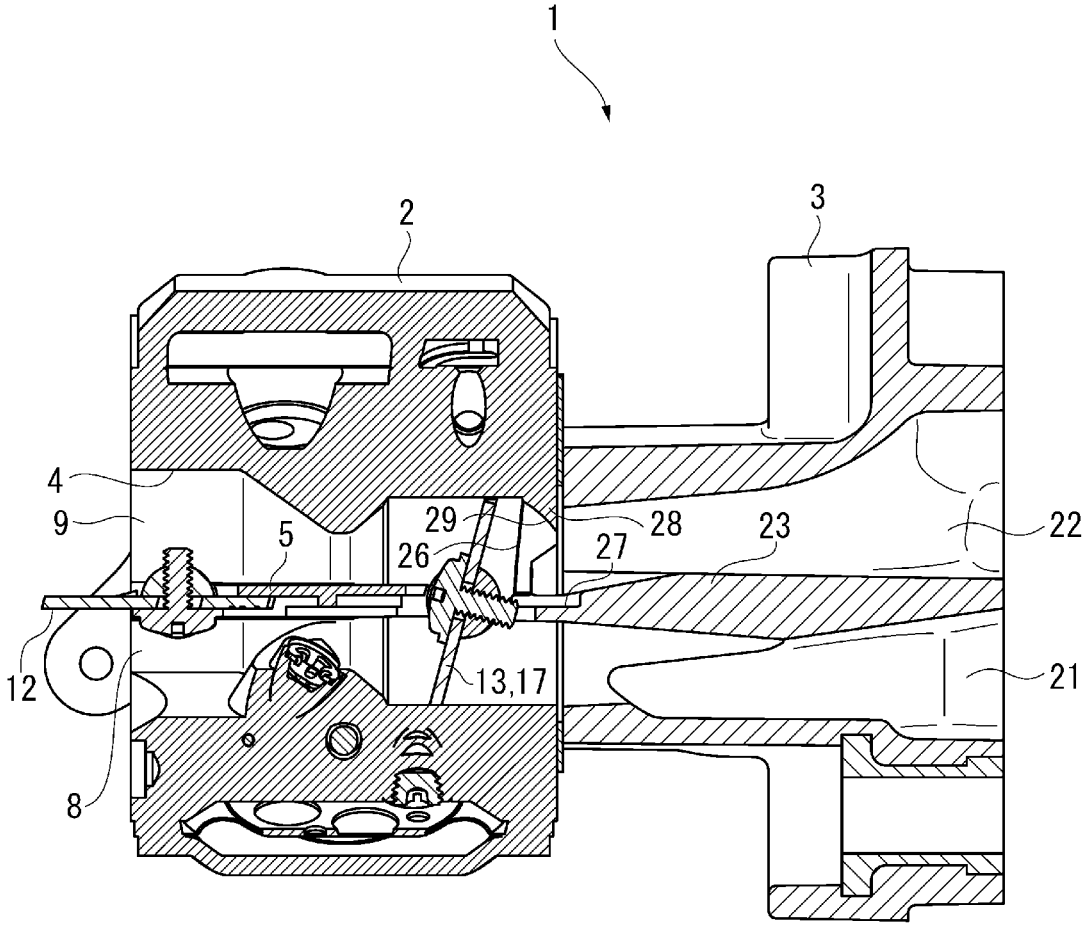

AIR SUPPLY DEVICE OF STRATIFIED SCAVENGING TWO-CYCLE ENGINE

TECHNICAL FIELD

The present invention relates to an air supply device of a stratified scavenging two-cycle engine. In particular, the present invention relates to an air supply engine provided with a carburetor and an insulator.

BACKGROUND ART

A carburetor applicable to a stratified scavenging two-cycle engine is provided with separate passages, i.e., a mixture passage for generating air-fuel mixture and supplying the air-fuel mixture to an engine body, and an air passage for supplying air for stratified scavenging (e.g., Patent Literature 1).

According to Patent Literature 1, a butterfly valve that is moved in conjunction with a throttle operation is provided in a bore forming each passage so as to control the flow rate of the air passing through the bore. Such a carburetor is attached to a cylinder block or the like of the engine body via an insulating member with heat insulation. Accordingly, the insulator is also necessarily provided with a mixture passage through which the air-fuel mixture passes, and an air passage through which air for stratified scavenging passes.

A carburetor for a conventional two-cycle engine, which is not stratified scavenging type, is originally configured as a single-bore carburetor provided with only one bore for air to flow in, which defines an inner space functioning as a mixture passage for air-fuel mixture. In order to apply such a single-bore carburetor to a stratified scavenging two-cycle engine, there has been typically known a technique of dividing the single mixture passage into two parts, i.e., one part as a mixture passage and the other part as an air passage (e.g., Patent Literature 1). Since being originally provided as a single-bore carburetor, such a carburetor is provided with one butterfly valve that is moved in conjunction with a throttle operation.

The single-bore carburetor of the above type, being applicable to a stratified scavenging two-cycle engine, is the same as a carburetor for a conventional two-cycle engine in terms of size and an operation mechanism of a butterfly valve and has a considerably small size and a simplified structure as compared with a carburetor provided with separate mixture passage and air passage. Thus, applying the single-bore carburetor to a stratified scavenging two-cycle engine allows reduction in the size of the engine and significantly contributes to weight reduction. Further, in the carburetor provided with the separate mixture passage and air passage, a throttle operation needs to be performed against return springs in butterfly valves respectively provided in these passages, so that the load during the operation is relatively large. However, the single-bore carburetor described the above has only one return spring. Using the single-bore carburetor leads to not only reduction in size and weight but also reduction of fatigue during operation.

CITATION LIST

Patent Literature

PTL 1: US 2006/0219217 A1
PTL 2: WO 08/033062 A1

SUMMARY OF INVENTION

Technical Problem

In the carburetor provided with the separate mixture passage and air passage, a timing at which the valve in the air passage is opened is usually delayed as compared with a timing at which the valve in the mixture passage is opened. In order to delay the timing, the valves are moved in conjunction with each other using a specific link mechanism. As a result, when the engine is driven in a speed range from an idling speed range to a low-middle speed range, supply of air for stratified scavenging to the engine body is stopped, thereby suppressing unstable combustion during idling.

In contrast, a single-bore carburetor is provided with only one butterfly valve moved in conjunction with a throttle. When the valve is moved by operating the throttle during idling, not only the part as a mixture passage but also the part as an air passage is undesirably opened at the same time, so that air for stratified scavenging is supplied to the engine body even in the above speed range. As a result, the uniformity of fuel concentration becomes impaired in a cylinder, which often causes unstable combustion.

An object of the invention is to provide an air supply device with a single bore applicable to a stratified scavenging two-cycle engine, the air supply device which is capable of improvement in combustion stability at a low-middle speed or lower.

Solution to Problem

According to an aspect of the invention, an air supply device of a stratified scavenging two-cycle engine, including: a carburetor provided with a single bore for air to flow in, the bore having therein a throttle valve provided by a butterfly valve that rotates in conjunction with a throttle operation so that, when the throttle valve is opened, a carburetor-side mixture passage for generated air-fuel mixture to flow in and a carburetor-side air passage for the air to directly flow in are substantially defined on a downstream side of the throttle valve in the bore; and an insulator provided on a downstream side of the carburetor, the insulator provided with an insulator-side mixture passage that is in communication with the carburetor-side mixture passage and an insulator-side air passage that is in communication with the carburetor-side air passage, the air supply device includes: a mixture passage defined by the carburetor-side mixture passage and the insulator-side mixture passage; an air passage defined by the carburetor-side air passage and the insulator-side air passage; and a flow-rate regulator provided inside the air passage, the flow-rate regulator bulging inward in the air passage, in which at least a part of a periphery of a valve body of the throttle valve is close to the flow-rate regulator until the valve body is rotated by a predetermined rotation angle from an initial position corresponding to an idling speed.

According to the above aspect of the invention, the flow-rate regulator that is close to the valve body of the throttle valve is provided in the air passage. Thus, by keeping the valve body close to the flow-rate regulator while the valve body is at a predetermined rotation angle from the idling speed range to a low-middle speed range, the air passage can be closed in such a speed range while opening only the mixture passage, so that the supply of air for stratified scavenging can be restrained. Accordingly, the uniformity of air-fuel mixture concentration in a cylinder is maintained in or below the low-middle speed range, so that a stable combustion can be achieved even when a single-bore carburetor is applied to a stratified scavenging two-stroke engine.

In the air supply device according to the above aspect of the invention, an extended portion that extends toward the carburetor to be fitted into the carburetor-side air passage of the carburetor may be provided near an upstream end of the insulator-side air passage of the insulator, and the flow-rate regulator may be provided on the extended portion as a part of the insulator. Alternatively, the insulator may include an insulator body provided on an engine body of the stratified scavenging two-cycle engine and an intermediate member interposed between the insulator body and the carburetor, an extended portion that extends toward the carburetor to be fitted into the carburetor-side air passage of the carburetor may be provided near an upstream end of a part of the intermediate member forming the insulator-side air passage, and the flow-rate regulator may be provided on the extended portion as a part of the intermediate member. Alternatively, the flow-rate regulator may be provided as a part of the carburetor near a downstream end of the carburetor-side air passage of the carburetor.

In the air supply device, it is preferable that the valve body of the throttle valve be close to the flow-rate regulator until the valve body is rotated from the initial position by a rotation angle of 20 to 40 degrees.

When the close state is released at a rotation angle of less than 20 degrees, the supply of the air for stratified scavenging in the low-middle speed range increases according to the shape of the flow-rate regulator, so that the combustion performance may not be sufficiently improved. In contrast, when the close state is kept at a rotation angle of over 40 degrees, the air for stratified scavenging may not be sufficiently supplied beyond the middle speed range, so that the emission may not be sufficiently reduced.

In the air supply device, it is preferable that an opposing surface of the flow-rate regulator that comes close to the valve body be a spherical surface extending along a rotation path of the valve body. With the above arrangement, while the valve body and the flow-rate regulator are close to each other, the clearance therebetween is constant, so that the supply of the air for stratified scavenging can be securely restrained.

In the air supply device, it is preferable that the flow-rate regulator be configured so that the close state relative to the valve body is gradually released as the valve body is rotated.

According to the above arrangement, since the close state between the valve body and the flow-rate regulator is not immediately released, the flow rate can be smoothly and evenly controlled in accordance with the rotation angle, thereby further stabilizing the combustion state.

BRIEF DESCRIPTION OF DRAWINGS

FIG. 1 is a cross-sectional view showing an air supply device according to a first exemplary embodiment of the invention.

FIG. 2 is a cross-sectional view showing a valve of the air supply device immediately before being opened.

FIG. 3 is an enlarged view, observed on the downstream side, showing the valve of FIG. 2.

FIG. 4 is a cross-sectional view showing the valve of the air supply device immediately after being opened.

FIG. 5 is an enlarged view, observed on the downstream side, showing the valve of FIG. 4.

FIG. 6 is a cross-sectional view showing the valve of the air supply device when being fully opened.

FIG. 7 is an enlarged view showing a first modification of the invention.

FIG. 8 is an enlarged view showing a second modification of the invention.

FIG. 9 is an enlarged view showing a third modification of the invention.

DESCRIPTION OF EMBODIMENTS

An exemplary embodiment of the invention will be described below with reference to the attached drawings.

As shown in FIG. 1, an air supply device 1 according to this exemplary embodiment, which is applied to a stratified scavenging two-cycle engine, includes a carburetor 2 that generates air-fuel mixture, and an insulator 3 disposed on the downstream side of the carburetor 2. Incidentally, the two-cycle engine is exemplified by an engine installed in a portable work machine such as a brushcutter, a chain saw, an engine blower or a hedge trimmer.

An air cleaner (not shown) is attached on the upstream side of the carburetor 2. The insulator 3 is fixed to a cylinder block of an engine body (not shown) with bolts or the like. Likewise, the carburetor 2 is fixed to the insulator 3 with bolts or the like. The insulator 3 is made of synthetic resin to have heat insulation. Thus, the insulator 3 prevents heat transfer from the engine body to the carburetor 2.

A detailed description will be made on the carburetor 2.

The carburetor 2 has a single-bore structure in which a single bore 4 through which air passes is provided. The contour, outer structure, size and the like of the carburetor 2 are identical to those of a single-bore carburetor for a conventional two-cycle engine, which is not stratified scavenging type. Incidentally, the carburetor 2 of this exemplary embodiment is applied to a stratified scavenging type engine and the inner space of the bore 4 is divided by a plate-shaped separator 5 into two passages.

One of the two passages is a carburetor-side mixture passage 8 in which a main jet 7 for ejecting fuel is provided to a venturi 6. The other passage is a carburetor-side air passage 9 through which only air for stratified scavenging passes. Air is introduced into both the passages 8 and 9 through a circular inflow opening 10 of the bore 4. In the carburetor-side mixture passage 8, fuel is ejected from the main jet 7 to the introduced air to generate air-fuel mixture. The air-fuel mixture is supplied to the insulator 3 through a circular outflow opening 11 of the bore 4. The air introduced into the carburetor-side air passage 9 is directly supplied to the insulator 3 through the outflow opening 11.

In the bore 4 of the carburetor 2, a choke valve 12 is disposed on the upstream side and a throttle valve 13 is disposed on the downstream side. The valves 12 and 13 are respectively rotated by rotation shafts 14 and 15 that extend along a depthwise direction of the figure. The valves 12 and 13 of this exemplary embodiment respectively include plate-shaped and substantially-circular valve bodies 16 and 17. The valve bodies 16 and 17 are respectively fixed to the rotation shafts 14 and 15 with screws 18 and 19. The choke valve 12 is rotated by operating a choke lever (not shown). The throttle valve 13 is rotated in conjunction with the operation of a throttle lever (not shown).

In FIG. 1, the choke valve 12 is set at a fully-opened position in which each of the carburetor-side mixture passage 8 and the carburetor-side air passage 9 is opened with the maximum opening area at the inflow opening 10. The choke valve 12 is usually fixed to this fully-opened position except when the engine is started, engine warm-up, or the like. In FIG. 1, the throttle valve 13 is set at an idling position (initial position), corresponding to an idling speed, in which each of the carburetor-side mixture passage 8 and the carburetor-side air passage 9 is completely closed near the outflow opening 11. However, the carburetor-side mixture passage 8 is opened via a communicating opening defined in the valve body 17 so as to supply a sufficient amount of the air-fuel mixture for maintaining at least the idling speed.

The separator 5 is disposed between the valves 12 and 13 as described above. When both the valves 12 and 13 are rotated to the fully-opened positions (see FIG. 6), the valve bodies 16 and 17 of the valves 12 and 13 are substantially linearly overlaid on the separator 5, so that the passages 8 and 9 are almost fully opened while being separated from each other.

Incidentally, though the separator 5 is provided in the bore 4 according to this exemplary embodiment, the separator 5 may only be provided as necessary (i.e., the separator 5 is omissible). Even when the separator 5 is omitted, by opening the throttle valve 13, the carburetor-side mixture passage 8 and the carburetor-side air passage 9 are substantially defined not only at an area divided by the throttle valve 13 but also on the downstream side of the throttle valve 13.

A detailed description will be made on the insulator 3.

The insulator 3 is provided with an insulator-side mixture passage 21 that is in communication with the carburetor-side mixture passage 8 of the carburetor 2, and an insulator-side air passage 22 that is in communication with the carburetor-side air passage 9. The carburetor-side mixture passage 8 and the insulator-side mixture passage 21 in combination form a mixture passage 40 according to the exemplary embodiment that penetrates the carburetor 2 and the insulator 3. The carburetor-side air passage 9 and the insulator-side air passage 22 in combination form an air passage 41 according to the exemplary embodiment that penetrates the carburetor 2 and the insulator 3.

The downstream end of the insulator-side mixture passage 21 is in communication with the inner space of a crankcase via an intake port provided on the cylinder block (not shown). The downstream end of the insulator-side air passage 22 is in communication with the vicinity of a scavenging port of a scavenging passage via an air port (not shown).

The intake port and the air port are opened and closed as a piston reciprocates to function as a piston valve (piston-valve type), or, alternatively, as a lead valve moves in response to pressure pulsation in the inner space of the crankcase (lead-valve type). When the piston moves upward to generate negative pressure in the inner space of the crankcase, the air-fuel mixture generated in the carburetor-side mixture passage 8 passes through the insulator-side mixture passage 21 and the intake port to be supplied to the inner space of the crankcase.

At the almost same time, the air for stratified scavenging introduced into the carburetor-side air passage 9 passes through the insulator-side air passage 22 and the air port to be stored in the scavenging passage near the scavenging port. The air stored in the scavenging passage is utilized in a scavenging process to scavenge combustion gas in a combustion chamber before the air-fuel mixture comes from the crankcase. Thus, in the stratified scavenging two-cycle engine, scavenging is initially performed by the air for stratified scavenging, so that discharge of unburned fuel contained in the air-fuel mixture in the scavenging process is restrained to improve emission.

The passages 21 and 22 of the insulator 3 are separated from each other by a centrally-disposed separate portion 23. An upstream opening 24 of the insulator-side mixture passage 21 and an upstream opening 25 of the insulator-side air passage 22 are formed in a semicircular shape. The upstream opening 25 of the insulator-side air passage 22 is provided with an extended portion 26 over the entire periphery of the opening that extends toward the carburetor 2. In molding the entire insulator 3, the extended portion 26 is also integrally formed. When the carburetor 2 is attached to the insulator 3, the extended portion 26 fits in the carburetor-side air passage 9.

The extended portion 26 defines a flattened portion 27 at a portion continuous with the separate portion 23. When the throttle valve 13 is rotated to the fully-opened position, the valve body 17 of the throttle valve 13 is brought into contact with the flattened portion 27. The valve body 17 and the flattened portion 27 are thus overlaid on each other. The flattened portion 27 extends in parallel with a rotation axis 15A of the throttle valve 13 (see FIG. 3). The extended portion 26 also defines a flow-rate regulator 28 at a portion corresponding to an arc portion of the upstream opening 25, the flow-rate regulator 28 bulging inward to partially close the upstream opening 25. The flow-rate regulator 28 is formed as a part of the insulator 3.

Being observed on the downstream side of the insulator-side air passage 22, as shown in FIG. 3, the flow-rate regulator 28 bulges in a crescentic shape into the insulator-side air passage 22. Both the ends of the flow-rate regulator 28 are spaced apart from both the ends of the flattened portion 27 by approximately the same length L1. As shown in FIG. 1, the shape of the cross section of the flow-rate regulator 28 is a substantial triangle. More specifically, the flow-rate regulator 28 defines a spherical surface 29 as an opposing surface that is close to the end of the valve body 17 during the rotation of the throttle valve 13. The spherical surface 29 extends along the rotation path of the valve body 17.

The flow-rate regulator 28 is kept close to the end of the valve body 17 for a while after the throttle valve 13 begins to rotate from the idling position. As a result, the carburetor-side mixture passage 8 begins to open simultaneously when the throttle valve 13 begins to rotate, so that the carburetor-side mixture passage 8 is promptly brought into communication with the insulator-side mixture passage 21. In contrast, the carburetor-side air passage 9 is brought into communication with the insulator-side air passage 22 with delay. In this exemplary embodiment, as shown in FIGS. 2 and 3, the carburetor-side air passage 9 is kept closed until the throttle valve 13 is rotated from the idling position by 20 to 40 degrees (in this exemplary embodiment, by 40 degrees).

When the rotation angle of the throttle valve 13 exceeds 40 degrees as shown in FIGS. 4 and 5, the carburetor-side air passage 9 is opened and brought into communication with the insulator-side air passage 22, so that the air for stratified scavenging is supplied to the engine body. The rotation angle of 40 degrees corresponds to a low-middle speed range of the engine speed. In other words, according to this exemplary embodiment, the air for stratified scavenging is prevented from being supplied to the engine body in the low-middle speed range, but the fresh air is supplied after the engine speed exceeds the low-middle speed range.

Further, as shown in FIG. 6, when the throttle valve 13 is rotated to be brought into contact with the flattened portion 27 of the valve body 17, the passages 8 and 9 of the carburetor 2 are fully opened with the maximum opening areas thereof.

Incidentally, since the air-fuel mixture side and the air side are separated by the separator 5, the valve body 17, the protruding flattened portion 27 and the like, the air-fuel mixture hardly comes into the insulator-side air passage 22 irrespective of the rotation angle of the throttle valve 13.

As described above, in the air supply device 1 according to this exemplary embodiment, the flow-rate regulator 28 is provided on the upstream end of the insulator-side air passage 22 at a position close to the valve body 17 of the throttle valve 13. Thus, when the throttle valve 13 is rotated by an angle corresponding to a range from the idling speed range to the low-middle speed range, the carburetor-side mixture passage 8 is opened while the carburetor-side air passage 9 is closed. As a result, in the above rotation range, the air for stratified scavenging is prevented from being supplied, thereby preventing impairment of the uniformity of air-fuel mixture concentration in a cylinder. Even when the carburetor 2 (the single-bore carburetor) is used in a stratified scavenging two-cycle engine, the combustion state can be stabilized.

It should be understood that the scope of the invention is not limited to the above-described exemplary embodiment, but includes any modifications as long as the object of the invention is achieved.

For instance, FIG. 7 shows an example (first modification of the invention) in which the formation position of the flow-rate regulator 28 is altered. In the above exemplary embodiment, both the ends of the flow-rate regulator 28 are spaced apart from both the ends of the flattened portion 27 by approximately the same length L1 (see FIG. 3). In contrast, in this first modification, one of the ends is positioned approximately at the flattened portion 27 and the other end is largely separated from the flattened portion 27 by a length L2 (L1<L2). The flattened portion 27 extends in parallel with the rotation axis 15A of the throttle valve 13 as in the above exemplary embodiment.

As a result, the carburetor-side air passage 9 is opened slightly earlier than that of the above exemplary embodiment (alternatively, may be opened upon the rotation of the valve body 17). However, the close state between the flow-rate regulator 28 and the valve body 17 is not immediately released over the entire area of the flow-rate regulator 28 upon exceeding a predetermined rotation angle, but is gradually released from a part of a periphery of the valve body 17 to open the carburetor-side air passage 9. Accordingly, the flow rate of the air for stratified scavenging at the start of opening the carburetor-side air passage 9 is sufficiently small and does not cause serious influence on the combustion state. Rather, by gradually opening the carburetor-side air passage 9 as in the first modification, a smooth and even flow rate control in accordance with the rotation angle can be achieved, thereby further stabilizing the combustion state.

Further, when the throttle valve 13 is fully opened, the opening area of the carburetor-side air passage 9 in the first modification is the same as that in the above exemplary embodiment. Accordingly, a sufficient amount of the air for stratified scavenging can be supplied in a high rotation range, so that emission can be securely improved.

Incidentally, the shape and the like of the flow-rate regulator 28 may be determined in any manner considering an engine displacement or required combustion characteristics and is not limited to those shown in the above exemplary embodiment and the first modification.

Further, the extended portion 26 having the flattened portion 27 and the flow-rate regulator 28 may be provided by a semicircular ring independent of the insulator 3 that is detachably fitted to the insulator 3 and the carburetor 2. At this time, a plurality of the extended portions 26 having differently shaped flow-rate regulators 28 may be prepared, an appropriate one of which may be selected to be used in accordance with required performance.

FIG. 8 shows an example (second modification of the invention) in which the insulator 3 is provided by an insulator body 30 on the side of the engine body and an intermediate member 31 interposed between the insulator body 30 and the carburetor 2, and the flow-rate regulator 28 is provided as a part of the intermediate member 31 forming the insulator-side air passage 22. The intermediate member 31 may be made of synthetic resin or, alternatively, made of metal.

The second modification provides the same advantages as the above exemplary embodiment in spite of the difference in the structure thereof, so that the object of the invention can be achieved.

FIG. 9 shows an example (third modification of the invention) in which the flow-rate regulator 28 is provided on the carburetor 2. Specifically, the flow-rate regulator 28 is provided near the downstream end of the carburetor-side air passage 9 as a part of the carburetor 2. In the insulator 3, only the flattened portion 27 is provided as the extended portion 26.

The third modification provides the same advantages as the above exemplary embodiment in spite of the difference in the structure thereof, so that the object of the invention can be achieved.

INDUSTRIAL APPLICABILITY

The invention is applicable to an air supply device of a stratified scavenging two-cycle engine installed in a portable work machine such as a brushcutter, a chain saw, an engine blower or a hedge trimmer.

REFERENCE SINGS LIST

1 . . . air supply device
2 . . . carburetor
3 . . . insulator
4 . . . bore
8 . . . carburetor-side mixture passage
9 . . . carburetor-side air passage
13 . . . throttle valve
17 . . . valve body
21 . . . insulator-side mixture passage
22 . . . insulator-side air passage
26 . . . extended portion
28 . . . flow-rate regulator
29 . . . spherical surface
30 . . . insulator body
31 . . . intermediate member
40 . . . mixture passage
41 . . . air passage

The invention claimed is:

1. An air supply device of a stratified scavenging two-cycle engine, comprising:

a carburetor provided with a single bore through which air passes, the single bore comprising a choke valve and a throttle valve, the choke valve disposed on an upstream side of the carburetor and the throttle valve disposed on a downstream side of the carburetor, wherein the throttle valve is provided by a butterfly valve that rotates in conjunction with a throttle operation, wherein in response to the throttle valve being opened, a carburetor-side mixture passage for generated air-fuel mixture to flow in and a carburetor-side air passage for the air to directly flow in are substantially defined on a downstream side of the throttle valve in the single bore;

an insulator provided on the downstream side of the carburetor and being fixed to a cylinder block of a body of the stratified scavenging two-cycle engine, the insulator provided with an insulator-side mixture passage that is in communication with the carburetor-side mixture passage and an insulator-side air passage that is in communication with the carburetor-side air passage;

a mixture passage defined by the carburetor-side mixture passage and the insulator-side mixture passage;

an air passage defined by the carburetor-side air passage and the insulator-side air passage; and a flow-rate regulator formed as part of the insulator, the flow-rate regulator provided on the downstream side of the throttle valve and inside the air passage, the flow-rate regulator bulging inward in the air passage, wherein at least a part of a periphery of a valve body of the throttle valve is located proximate to the flow-rate regulator until the valve body is rotated by a predetermined rotation angle from an initial position, the initial position corresponding to an idling speed, wherein in response to the valve being rotated from the initial position, the carburetor-side mixture passage opens to be brought into communication with the insulator-side mixture passage and the carburetor-side air passage is brought into communication with the insulator-side air passage with a delay relative to the communication between the carburetor-side mixture passage and the insulator-side mixture passage;

wherein an extended portion of the flow-rate regulator extends into and is fitted within the carburetor-side air passage of the carburetor at an upstream end of the insulator-side air passage of the insulator, the extended portion being disposed over an entire periphery of the carburetor-side air passage of the upstream end.

2. The air supply device of a stratified scavenging two-cycle engine according to claim 1, wherein the insulator includes an insulator body provided on the body of the stratified scavenging two-cycle engine and an intermediate member interposed between the insulator body and the carburetor, wherein the extended portion is provided near an upstream end of a part of the intermediate member forming the insulator-side air passage, and the flow-rate regulator is provided on the extended portion as a part of the intermediate member.

3. The air supply device of a stratified scavenging two-cycle engine according to claim 1, wherein the valve body of the throttle valve is located proximate to the flow-rate regulator until the valve body is rotated from the initial position by a rotation angle of 20 to 40 degrees.

4. The air supply device of a stratified scavenging two-cycle engine according to claim 1, wherein an opposing surface of the flow-rate regulator that is located proximate to the valve body is a spherical surface extending along a rotation path of the valve body.

5. The air supply device of a stratified scavenging two-cycle engine according to claim 1, wherein the flow-rate regulator is configured so that a close state relative to the valve body is gradually released as the valve body is rotated.

6. The air supply device of a stratified scavenging two-cycle engine according to claim 1, wherein the insulator is molded and the extended portion is integrally formed with the insulator.

7. The air supply device of a stratified scavenging two-cycle engine according to claim 1, wherein the flow-rate regulator is configured so that when the throttle value is rotated by an angle corresponding to a range from the idling speed to a low-middle speed, the mixture passage is opened while the air passage is closed.

8. The air supply device of a stratified scavenging two-cycle engine according to claim 1, wherein the insulator is formed of synthetic resin configured to prevent heat transfer from the body of the engine to the carburetor.

9. The air supply device of a stratified scavenging two-cycle engine according to claim 1, wherein the flow-rate regulator defines a spherical surface that extends along a rotation path of the part of the periphery of the valve body of the throttle valve that rotates by the predetermined rotation angle from the initial position.

10. The air supply device of a stratified scavenging two-cycle engine according to claim 1, wherein the insulator and the carburetor are formed of different materials, the insulator being formed of a material that inhibits heat transfer from the engine body to the carburetor.

11. The air supply device of a stratified scavenging two-cycle engine according to claim 1, wherein the flow-rate regulator comprises a flattened portion that is recessed such that a portion of a valve body of the throttle valve is configured to overlay the flattened portion and is received into the flattened portion when in the throttle valve is in a fully-open position.

12. The air supply device of a stratified scavenging two-cycle engine according to claim 11, wherein the flattened portion extends in parallel with the rotation axis of the throttle valve.

13. The air supply device of a stratified scavenging two-cycle engine according to claim 1, wherein a bulge of the flow-rate regulator into the air passage has a crescentic shape.

14. An air supply device of a stratified scavenging two-cycle engine, comprising:

a carburetor provided with a single bore through which air passes, the single bore comprising a choke valve and a throttle valve, the choke valve disposed on an upstream side of the carburetor and the throttle valve disposed on a downstream side of the carburetor, wherein the throttle valve is provided by a butterfly valve that rotates in conjunction with a throttle operation, wherein in response to the throttle valve being opened, a carburetor-side mixture passage for generated air-fuel mixture to flow in and a carburetor-side air passage for the air to directly flow in are substantially defined on a downstream side of the throttle valve in the single bore;

an insulator provided on the downstream side of the carburetor and being fixed to a cylinder block of a body of the stratified scavenging two-cycle engine, the insulator provided with an insulator-side mixture passage that is in communication with the carburetor-side mixture passage and an insulator-side air passage that is in communication with the carburetor-side air passage;

a mixture passage defined by the carburetor-side mixture passage and the insulator-side mixture passage;

an air passage defined by the carburetor-side air passage and the insulator-side air passage; and a flow-rate regulator formed as part of the insulator, the flow-rate regulator provided on the downstream side of the throttle valve and inside the air passage, the flow-rate regulator bulging inward in the air passage, wherein at least a part of a periphery of a valve body of the throttle valve is located proximate to the flow-rate regulator until the valve body is rotated by a predetermined rotation angle from an initial position, the initial position corresponding to an idling speed, wherein in response to the valve being rotated from the initial position, the carburetor-side mixture passage opens to be brought into communication with the insulator-side mixture passage and the carburetor-side air passage is brought into communication with the insulator-side air passage with a delay relative to the communication between the carburetor-side mixture passage and the insulator-side mixture passage;

wherein an extended portion of the flow-rate regulator extends into and is fitted within the carburetor-side air passage of the carburetor at an upstream end of the insulator-side air passage of the insulator, the extended portion being disposed over an entire periphery of the carburetor-side air passage of upstream end;

wherein the extended portion of the flow-rate regulator comprises a spherical surface that extends along a rotation path of the valve body.

* * * * *